US005307920A

United States Patent [19]

Meyer et al.

[11] Patent Number: 5,307,920

[45] Date of Patent: May 3, 1994

[54] MOVING HANDRAIL DRIVE

[75] Inventors: Helmut J. W. Meyer, Bückeburg; Hermann W. Ahls, Obernkirchen, OT Vehlen; Klous Blaseck, Burgdorf-Ehlershausen, all of Fed. Rep. of Germany

[73] Assignee: Otis Elevator Company, Farmington, Conn.

[21] Appl. No.: 120,981

[22] Filed: Sep. 14, 1993

[51] Int. Cl.[5] ..... B66B 23/04

[52] U.S. Cl. ..... 198/335; 198/814; 198/833

[58] Field of Search ..... 198/335, 336, 813, 814, 198/833

[56] References Cited

U.S. PATENT DOCUMENTS

| | | | |
|---|---|---|---|
| Re. 25,531 | 3/1964 | Fabula | 198/336 |
| 2,102,248 | 12/1937 | Yeakel | 198/814 X |
| 2,677,456 | 5/1954 | McCann | 198/814 |
| 2,764,031 | 9/1956 | Nystrom | 198/814 X |
| 3,749,224 | 7/1973 | Engeler | 198/335 X |
| 4,134,883 | 1/1979 | Mendelsohn et al. | 198/335 X |
| 4,200,177 | 4/1980 | Sato et al. | 198/335 |
| 4,895,240 | 1/1990 | Bruehl et al. | 198/335 X |
| 5,117,960 | 6/1992 | Ahls et al. | 198/335 |

FOREIGN PATENT DOCUMENTS

| | | | |
|---|---|---|---|
| 0031479 | 3/1977 | Japan | 198/335 |
| 2-295886 | 12/1990 | Japan | 198/335 |
| 1393745 | 5/1988 | U.S.S.R. | 198/335 |

*Primary Examiner*—D. Glenn Dayoan

[57] ABSTRACT

An escalator handrail drive system includes a powered drive belt which engages the underneath surface of the handrail along the return path of travel of the latter. A series of pressure rollers engage the outer surface of the handrail to press the latter against the drive belt. The pressure rollers are all biased against the handrail by a single spring. The drive belt is pretensioned by an adjustable pretension spring assembly which can apply a fixed pretensioning force to the drive belt which will not substantially change irrespective of whether the handrail is being driven in the "up" direction or in the "down" direction on the escalator.

7 Claims, 4 Drawing Sheets

MOVING HANDRAIL DRIVE

TECHNICAL FIELD

This invention relates to a handrail drive assembly for use in a passenger conveyor such as an escalator, and more particularly to a handrail drive assembly which includes a powered drive belt to supply the motive power to the handrail.

BACKGROUND ART

Moving handrails on an escalator or moving walkway are typically driven by passing the handrails through a driving pressure nip along the return path of travel of the handrail beneath the balustrades. The nip may be formed by a pair of cooperating rollers, or by a driven belt which cooperates with a plurality of backup rollers. The nip will be powered by chains or the like which are driven by the main drive mechanism of the escalator. Soviet Patent No. SU1286-493A, U.S. Pat. No. 4,134,883, and Austrian Patent No. 247,236 disclose variations of the prior art drive systems described above.

U.S. Pat. No. 5,117,960, granted Jun. 2, 1992 to H. W. Ahls, et al. discloses a handrail drive system which uses a powered drive belt and a pressure belt to drive the handrail along its path of travel. The drive belt is entrained on a powered drive roller, and a free wheeling idler roller. The idler roller is biased by a spring to provide an adjustable tension to the drive belt. A series of adjustable but non-biased backup rollers provide a backing force for the drive belt which holds the latter against the handrail between the drive roller and the idler roller. The pressure belt is entrained on a pair of idler rollers, one of which is spring biased to provide pressure belt tension. A plurality of pressure rollers are disposed between the pressure idler rollers and are individually spring biased against the pressure belt so as to press the latter against the handrail.

The handrail drive system described in the aforesaid U.S. Pat. No. 5,117,960 patent is serviceable, but exhibits certain drawbacks. The use of a pressure belt requires additional hardware to mount the pressure belt and does not add any drive power or stability to the system. The use of individual pressure roller springs renders the drive assembly difficult to properly adjust. The individual pressure springs also limit the flexibility of the force imparted to the handrail which presses the handrail against the drive belt. Finally, the tension spring assemblies which are used to impart tension to the drive belt and the pressure belt, and thus reduce or eliminate belt slippage, are vulnerable to forces which emanate from the handrail that tend to vary the belt tension depending on whether the handrail is being moved in the upward or downward direction, i.e., toward, or away from the belts' tension rollers.

When the handrail is moved in the upward direction, there is greater frictional drag imparted to the handrail by the guide rails which must be overcome by the drive assembly, than when the handrail is moved in the downward direction. When the handrail drive assembly is installed on the escalator, the belt power roller will be below the belt tension roller, and that relationship will not change, whether the handrail is being moved in the upward or downward direction. Thus, the handrail will be moved toward the tension roller when the handrail moves in the upward direction and away from the tension roller when the handrail moves in the downward direction. Since the tension roller is always biased away from the drive roller, the direction of movement of the handrail will tend to lessen the degree of compression of the tension spring if the drive belt is moving toward the tension roller; and will tend to increase the degree of compression of the tension spring if the drive belt is moving away from the tension roller. When the tension spring is further compressed, a decrease in drive belt tension ensues with a concurrent lessening of the driving force applied to the handrail and even drive belt slippage. The result of the aforesaid drive belt tension instability is an inability to accurately control the bidirectional drive force imposed on the handrail by the drive belt. Drive belt tension must be adjusted to take into account the desired direction of movement of the handrail. This factor mitigates against the use of escalators that can be directionally reversed to account for passenger traffic flow. The same applies to horizontal moving walkways, which are typically much longer than escalators.

DISCLOSURE OF THE INVENTION

This invention relates to an escalator or moving walkway passenger conveyor handrail drive system which utilizes a handrail drive belt to supply motive force to the handrail. The system preferably uses a series of pressure rollers which directly contact the handrail and bias the latter against the drive belt. The drive belt is pretensioned with a tension or idler roller spring assembly which acts as a flexible tensioner when the handrail is being moved toward the idler roller; and which acts as a fixed tensioner when the handrail is being moved away from the idler roller. The pretensioning force applied to the drive belt is thus maintained in either direction of movement of the handrail. The quantum of pretensioning force is determined by a simple visual adjustment of components of the idler roller spring assembly, which adjustment does not require any particular skill or force measurements.

The pressure rollers are all mounted on a spring-biased mounting assembly which is pyramidal in configuration. The mounting assembly is biased by a single spring which is disposed at the apex of the pyramid, and the pressure rollers are located along the base of the pyramid. The pressure rollers are arranged in pairs mounted on brackets which can pivot relative to the handrail so as to provide a flexible biasing of the handrail against the drive belt. The force applied to the handrail thus accommodates variations in handrail thickness and is relatively constant due to the use of the single spring.

It is therefore an object of this invention to provide an improved drive assembly for a moving handrail on a passenger conveyor, which drive assembly utilizes a linear drive belt to provide motive power to the handrail.

It is a further object of this invention to provide a handrail drive assembly of the character described wherein the handrail is pressed against the drive belt by a series of pressure rollers which are all biased toward the handrail by a single spring.

It is an additional object of this invention to provide a handrail drive assembly of the character described wherein a substantially constant tensioning force is applied to the drive belt irrespective of the direction of movement of the handrail.

It is another object of this invention to provide a handrail drive assembly of the character described wherein the drive belt tensioning force is established by a simple visually confirmed adjustment.

These and other objects and advantages of this invention will become more readily apparent to one skilled in the art from the following detailed description of a preferred embodiment of the invention when taken in conjunction with the accompanying drawings, in which:

BEST MODE FOR CARRYING OUT THE INVENTION

Figure 1:
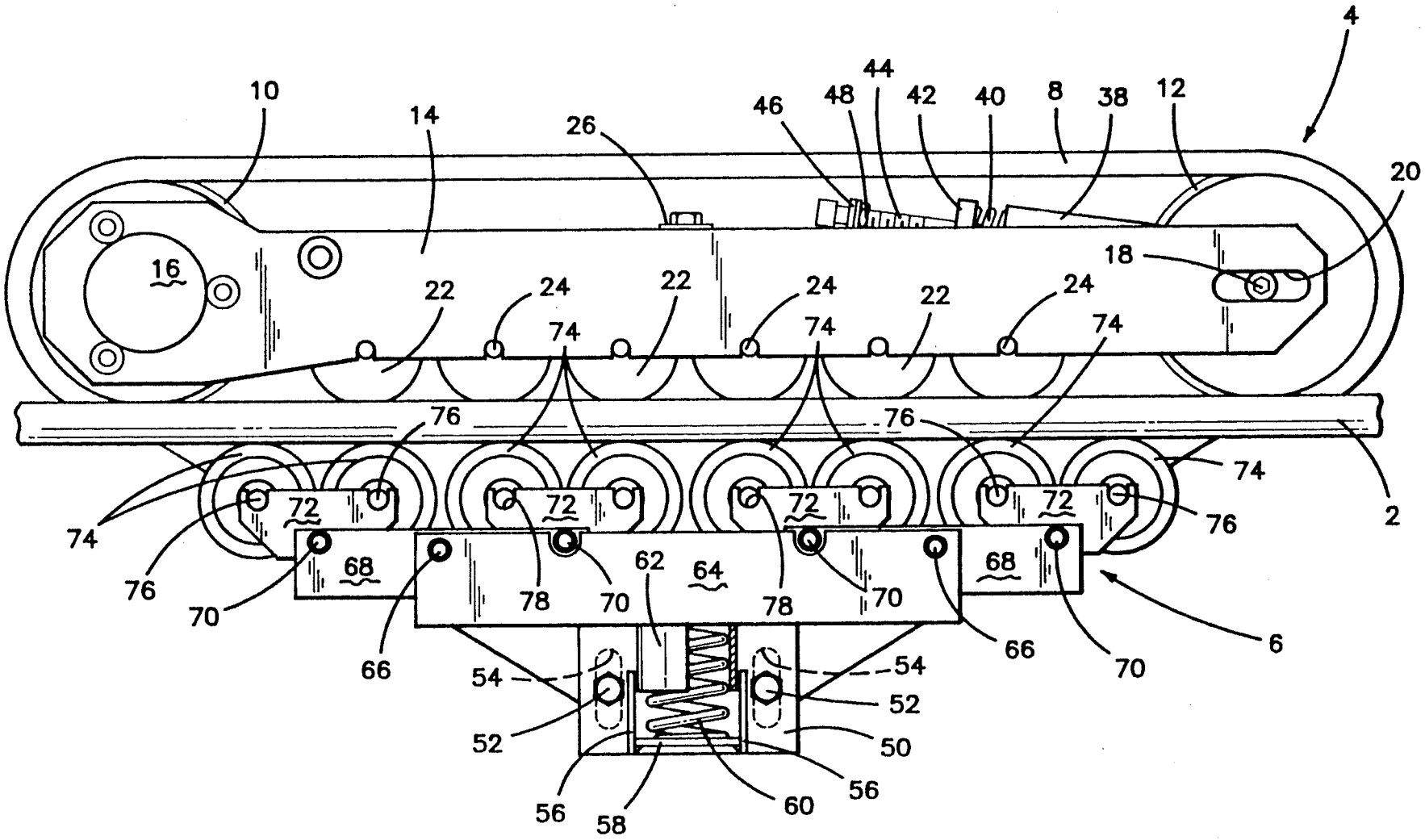
FIG. 1 is a side elevational view of an embodiment of the handrail drive assembly formed in accordance with this invention.

Referring now to the drawings, there is shown a preferred embodiment of a moving handrail drive assembly for use with a passenger conveyor such as an escalator or moving walkway. The handrail is designated generally by the numeral 2, and it moves between a powered drive section 4 and a pressure section 6 of the drive assembly. It will be appreciated that the drive assembly is positioned along the return path of travel of the handrail 2 so that the latter is shown in its inverted position in FIG. 1.

The powered section 4 of the drive assembly includes a drive belt 8 which is reeved over a powered drive pulley 10 and a biased tension pulley 12. A primary support bracket 14 supports the entire drive assembly on the conveyor truss, as will be described in greater detail hereinafter. The drive pulley 10 is mounted on a hub 16 journaled on the primary support bracket 14, and the tension pulley 12 is mounted on a shaft 18 which is slidably disposed in an elongated slot 20 in the primary support bracket 14. The drive belt 8 has an inner ribbed surface which engages matching ribs on the drive pulley 10 and tension pulley 12, as best shown in FIG. 4. The drive belt 8 is formed from a high modulus polyurethane material. The powered section 4 also includes a plurality of reaction rollers 22 which are rotatably mounted via bearings 23 (see FIG. 3) on axles 24 secured to the primary support bracket 14. The reaction rollers 22 engage the inner surface of the drive belt 8. As most clearly shown in FIG. 3, the primary support bracket 14 includes a flange 26 which connects the bracket 14 to a long bolt 28 having a threaded end 30 which allows the bolt 28 to be adjustably mounted on the conveyor truss 32. The bracket 14 can thus be moved up and down on the truss 32 so as to properly position the power section 4 and its components relative to the handrail 2.

Figure 4:
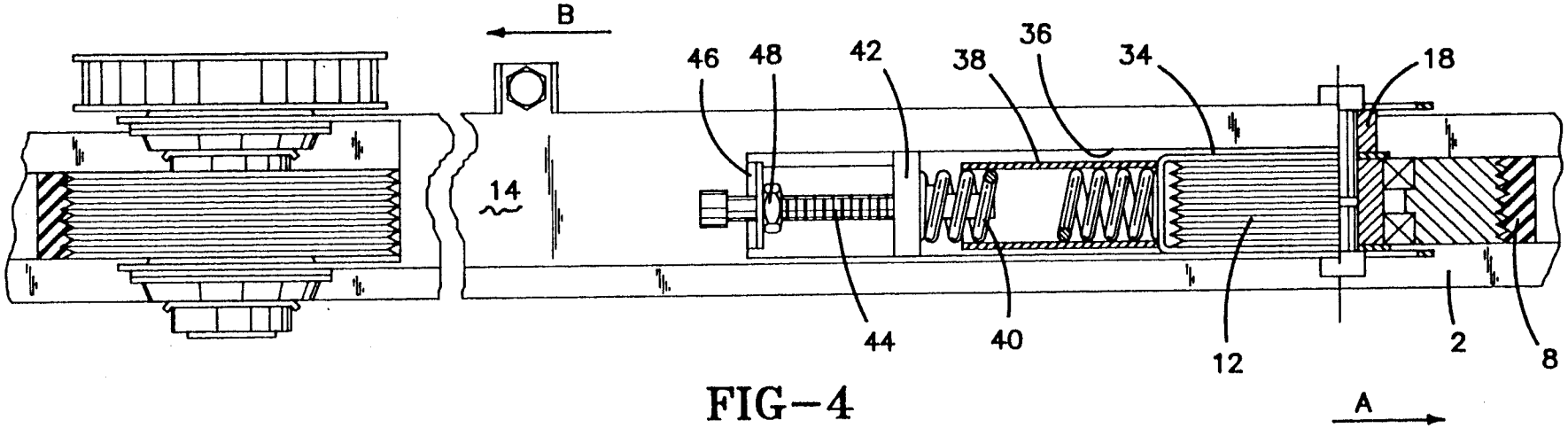
FIG. 4 is a top plan view of the drive assembly showing the drive belt tension pulley mounting assembly.
Figure 5:
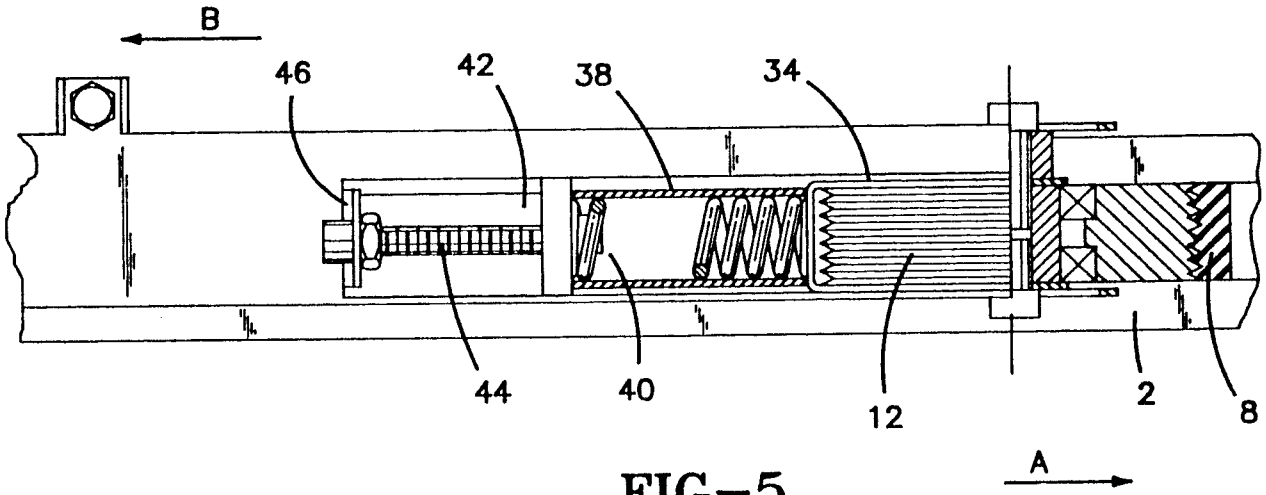
FIG. 5 is a fragmented view similar to FIG. 4 but showing the tension pulley adjustment mechanism set to its predetermined belt tensioning position.

Referring to FIGS. 4 and 5, the manner in which the tension pulley 12 is properly adjusted is shown. The pulley 12 is rotatably mounted in a clevis 34, and the clevis 34 and pulley 12 are positioned in a slot 36 in the primary support bracket 14. A tube 38 is seated against the clevis 34 and a tension spring 40 is disposed in the tube 38. One end of the tension spring 40 is seated against the clevis 34 and the other end is seated against a spring stop 42 which is mounted on an adjustable bolt 44. The bolt 44 is threaded through a tab 46 which is integral with the primary support bracket 14 so that the bolt 44 and spring stop 42 can be adjustably moved relative to the support bracket 14. A lock nut 48 is mounted on the bolt 44 for use in fixing the position of the bolt 44 and spring stop 42 after a predetermined adjustment had been made.

FIG. 4 shows the bolt 44 and spring stop 42 in a first position relative to the bracket 14 and tube 38 wherein the spring stop 42 is spaced apart from the tube 38. In this position, the tension pulley 12 will be tensioned to a predetermined degree so as to be able to apply a predetermined tension to the drive belt 8, which is proportional to the distance between the bracket tab 46 and the centerline of the tension pulley axle 18. This distance is, in turn, partially dependent on the length of the compressed spring 40. In the case of an escalator, assuming that the arrow A in FIGS. 4 and 5 points in the upward direction, and the arrow B points in the downward direction, it will be noted that all of the drive friction developed between the drive belt 8 and the handrail 2 occurs on the downward side of the tension pulley 12.

Thus, when the handrail 2 is being driven in the upward direction, drag or friction forces will be vectored in the direction of the arrow A and will not impart any force on the spring 40 that would tend to further compress it or shorten its adjusted length. This means that preset tension on the drive belt 8 will not be appreciably changed when the handrail 2 is being driven in the upward direction, i.e., with the direction of the arrow A. On the other hand, when the handrail 2 is being driven in the downward direction the drag forces will be vectored in the direction of the arrow B which will impart a compressive force on the tension spring 40. Thus, if the spring 40 is free to further compress, and if the drag forces are of sufficient magnitude to overcome the spring force, the spring 40 will shorten and the preset drive belt tension will lessen.

FIG. 5 shows the bolt 44 and spring stop 42 in a second position wherein the spring 40 is stabilized against compressive forces generated when the handrail 2 moves in the direction of the arrow B. In order to thus stabilize the spring 40, the bolt 44 is screwed into the tab 46 so as to move the spring stop 42 into abutting contact with the tube 38. When the spring stop 42 contacts the tube 38, the spring 40 will be compressed to a predetermined degree, and drag forces acting in the direction of the arrow B will not result in further compression of the spring 40. The preset tension on the drive belt 8 is thus maintained regardless of which direction the handrail 2 moves. It will be readily understood that by varying the length of the tube 38, the pressure exerted on the drive belt 8 by the spring 40 can be varied so that a tube length can be preselected to automatically provide the desired drive belt tension. The mechanic thus cannot over tension the drive belt 8, and the proper adjustment is obtained visually.

Figure 6:
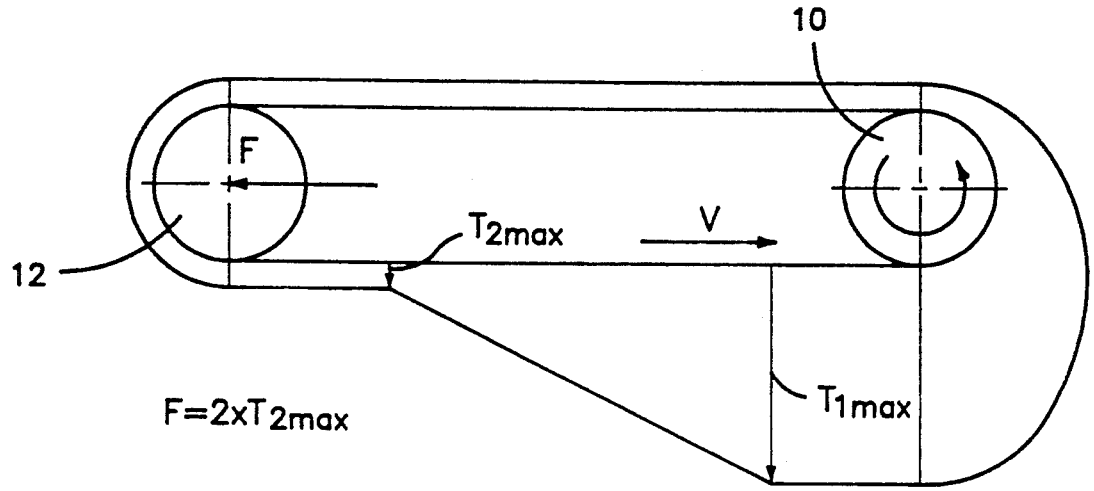
FIGS. 6 and 7 are drive belt tensile force diagrams describing the forces applied by the drive belt in both directions of movement of the handrail.
Figure 7:
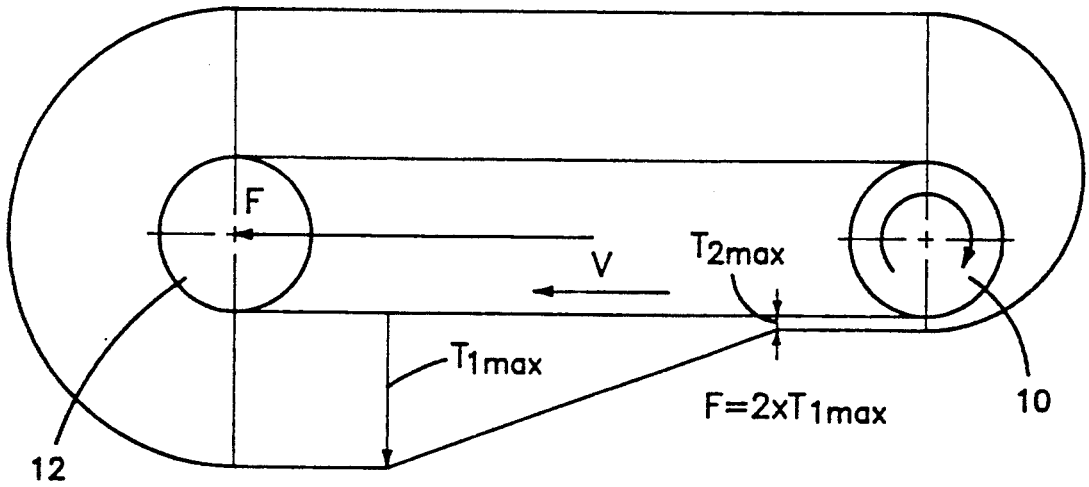

FIGS. 6 and 7 are functional diagrams of the forces exerted on the tension pulley 12 by the drag between the drive belt and the handrail when the latter is moved downwardly toward the drive pulley 10 (see FIG. 6) and upwardly toward the tension pulley 12 (see FIG. 7). By using the non-compressible spring mount, a substantial increase in driving power in the downward direction is obtained.

Figure 2:
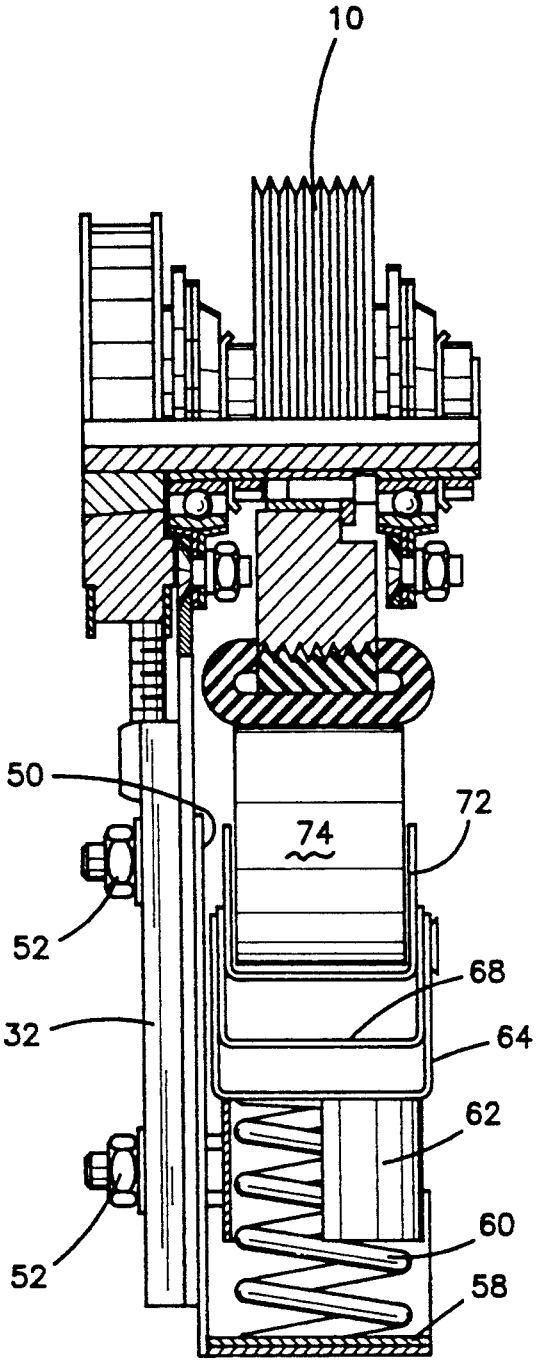
FIG. 2 is an end elevational view of the drive assembly taken partially in section at the powered drive belt pulley.
Figure 3:
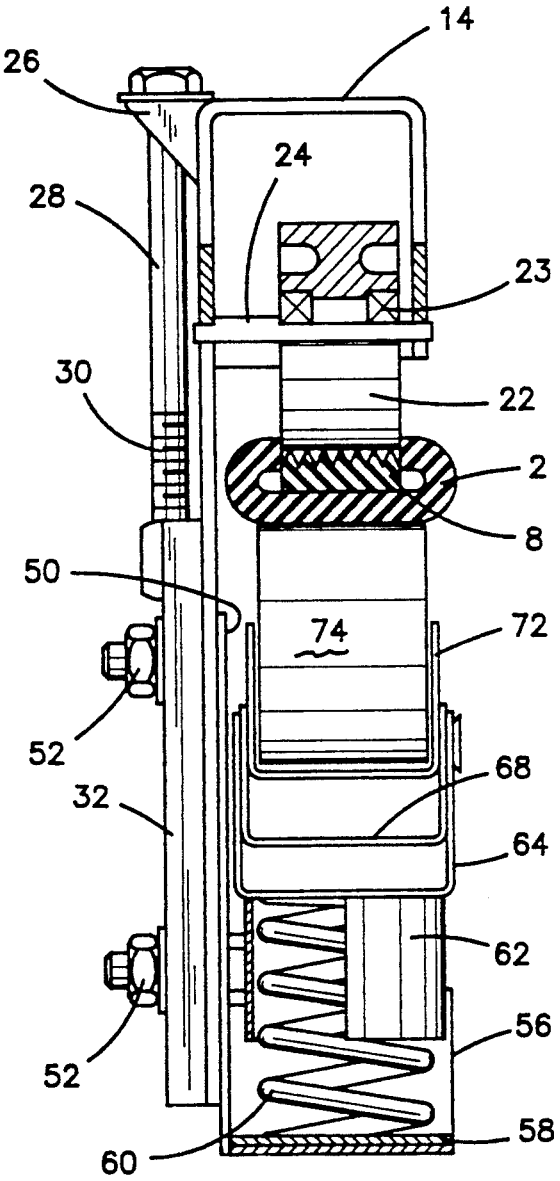
FIG. 3 is a view similar to FIG. 2 but showing one of the reaction rollers partially in section.

Referring now to FIGS. 1-3, details of the mounting system used in the pressure section 6 are shown. A mounting plate 50 is connected to the primary support bracket 14 via bolts 52 which extend through elongated slots 54 in the bracket 14. The plate 50 includes a pair of spaced flanges 56 between which extends a spring seat 58 on which a single pressure spring 60 rests. The spring 60 extends upwardly into a guide tube 52 and bears against an elongated U-shaped bracket 64. The bracket 64 supports a pair of shafts 66 on which a pair of intermediate elongated U-shaped brackets 68 are pivotally mounted. Each of the brackets 68 in turn supports a pair of axles 70 on which pressure roller brackets 72 are pivotally mounted. Each of the brackets 72 carries a pair of pressure rollers 74 which engage the outer surface of the handrail 2.

It will be noted that the spring guide tube 62 telescopes into the space between the flanges 56 so that the spring 60 can expand and contract in response to forces imposed on the pressure rollers 74 by the handrail 2. The mounting assembly is essentially pyramidal thus allowing the single spring 60 to provide all of the biasing force which serves to press the rollers 74 against the handrail 2. The spring pressure is thus derived from a single source, and can be easily adjusted by properly positioning the plate 50 on the bracket 14. Each of the brackets 68 and 72 is pivotally flexible independently from the others whereby the individual pressure rollers 74 can easily react to variations in handrail thickness. It will also be noted that the pressure rollers 74 are mounted on shafts 76 which are set into notches 78 in the brackets 72 so that a maintenance mechanic can readily remove the pressure rollers 74 from the brackets 72 so as to disengage the pressure section 6 from the handrail 2. This allows the handrail 2 and the drive assembly to be readily serviced and repaired.

It will be readily appreciated that the handrail will be biased against the drive belt with a readily controllable and evenly distributed force which when set, does not require fine tuning; and which is flexibly imposed on the handrail irrespective of localized variations in the thickness of the handrail. The drive belt tension is easily and accurately adjustable so that the drive belt tension will remain substantially fixed irrespective of whether the handrail is being driven in the upward or the downward direction.

Since many changes and variations of the disclosed embodiment of the invention may be made without departing from the inventive concept, it is not intended to limit the invention otherwise than as required by the appended claims.

What is claimed is:

1. A drive assembly for moving a handrail on a passenger conveyor, said drive assembly comprising:

a) a drive belt engaging a first surface on the handrail and supplying a motive force to the handrail;

b) a powered pulley engaging one end of the drive belt, and a tension pulley assembly engaging an opposite end of the drive belt, said powered pulley being operable to drive the drive belt through an endless path of travel defined by the powered pulley and the tension pulley;

c) reaction means engaging a second surface on the handrail to bias the handrail against the drive belt;

d) tension adjustment means operable to adjust position of said tension pulley assembly relative to said powered pulley so as to adjust the degree of pretension of the drive belt; and e) means associated with said tension adjustment means and operable to prevent movement of said tension pulley assembly toward said powered pulley when said drive belt is moving the handrail from said tension pulley assembly toward said powered pulley thereby preserving the degree of pretension applied to said drive belt.

2. The drive assembly of claim 1 wherein said tension adjustment means comprises a coil spring engaging said tension pulley assembly; a fixed stop adjacent to said coil spring; threaded means engaging said spring for varying compression of said spring; and an adjustable stop mounted on said threaded means, said adjustable stop being movable on said threaded means to a fixed stop-engaging position wherein said spring is rendered non-compressible.

3. The drive assembly of claim 2, wherein said threaded means comprises a bolt adjustably mounted on a truss member of the passenger conveyor.

4. The drive assembly of claim 1 wherein said reaction means comprises a plurality of rollers engaging the handrail, said rollers being mounted on a pyramidal stack of brackets, all of which are biased toward the handrail by a single spring means.

5. The drive assembly of claim 4 wherein said rollers are associated in pairs and wherein each pair of associated rollers is mounted on a proximal bracket in a series of the latter in said pyramidal stack, said proximal brackets being closest to the handrail; and additionally comprising medial brackets adjacent to said proximal brackets, each of said medial brackets having proximal brackets pivotally mounted thereon; and a distal bracket furthest from the handrail, said distal bracket having medial brackets pivotally connected thereto, said distal bracket engaging said single spring means.

6. A drive assembly for moving a handrail on a passenger conveyor, said drive assembly comprising:

a) a drive belt assembly engaging a first surface on the handrail and supplying a motive force to the handrail; and b) reaction means engaging a second surface on the handrail and biasing the handrail against the drive belt, said reaction means comprising a plurality of rollers engaging the handrail, said rollers being mounted on a pyramidal stack of brackets, all of which are biased toward the handrail by a single spring means.

7. The drive assembly of claim 6 wherein said rollers are associated in pairs and wherein each pair of associated rollers is mounted on a proximal bracket in a series of the latter in said pyramidal stack, said proximal brackets being closest to the handrail; and additionally comprising medial brackets adjacent to said proximal brackets, each of said medial brackets having proximal brackets pivotally mounted thereon; and a distal bracket furthest from the handrail, said distal bracket having medial brackets pivotally connected thereto, said distal bracket engaging said single spring means.

* * * * *